US005172865A

United States Patent [19]

Takano et al.

[11] Patent Number: 5,172,865

[45] Date of Patent: Dec. 22, 1992

[54] FUEL SUPPLY DEVICE OF AN ENGINE

[75] Inventors: Yuichi Takano; Takahiro Kushibe; Naotaka Shirabe, all of Susono, Japan

[73] Assignees: Toyota Jidosha Kabushiki Kaisha; Nippondenso Co., Ltd., both of Japan

[21] Appl. No.: 737,890

[22] Filed: Jul. 25, 1991

Related U.S. Application Data

[63] Continuation of Ser. No. 398,981, Aug. 28, 1989, abandoned.

[30] Foreign Application Priority Data

Jan. 12, 1989 [JP] Japan ..... 1-3849

[51] Int. Cl.[5] ..... F02M 67/02

[52] U.S. Cl. ..... 239/408; 239/432; 239/433; 239/533.7; 239/533.12; 123/531

[58] Field of Search ..... 239/533.2, 533.3, 533.7, 239/533.9, 533.12, 408, 413, 432, 433; 123/462, 531, 447, 467

[56] References Cited

U.S. PATENT DOCUMENTS

| | | | |
|---|---|---|---|
| 1,085,075 | 1/1914 | Willmer | 123/531 |
| 1,279,775 | 9/1918 | Sprado | 123/531 |
| 1,615,457 | 1/1927 | Jorgensen . | |
| 1,658,026 | 2/1928 | Blanding | 123/462 |
| 1,755,192 | 4/1930 | Scott | 239/533.9 |
| 3,782,639 | 1/1974 | Boltz et al. . | |
| 4,082,224 | 4/1978 | Mangus | 239/533.12 |
| 4,221,192 | 9/1980 | Badgley | 123/462 |
| 4,462,760 | 7/1984 | Sarich et al. . | |
| 4,497,443 | 2/1985 | Sauer | 239/533.3 |
| 4,545,354 | 10/1985 | Jaggle et al. | 123/531 |
| 4,634,055 | 1/1987 | Hans et al. | 239/533.3 |
| 4,651,931 | 3/1987 | Hans et al. | 239/533.11 |
| 4,693,224 | 9/1987 | Mckay . | |
| 4,712,524 | 12/1987 | Smith et al. | 123/531 |
| 4,759,335 | 7/1988 | Ragg et al. | 123/531 |
| 4,771,754 | 9/1988 | Reinke . | |
| 4,794,901 | 1/1989 | Hong et al. | 123/533 |
| 4,794,902 | 1/1989 | McKay | 123/531 |
| 4,823,756 | 4/1989 | Ziejewski et al. | 123/531 |
| 4,905,907 | 3/1990 | Ricco | 239/533.11 |
| 5,016,597 | 5/1991 | Borst | 123/533 |
| 5,036,824 | 8/1991 | Albertson et al. | 123/531 |

FOREIGN PATENT DOCUMENTS

| | | | |
|---|---|---|---|
| WO87/00583 | 1/1987 | Australia . | |
| WO88/07628 | 10/1988 | Australia . | |
| 2444597 | 4/1976 | Fed. Rep. of Germany | 239/533.12 |
| 3808671 | 9/1988 | Fed. Rep. of Germany . | |
| 488809 | 11/1918 | France . | |
| 489976 | 3/1919 | France . | |
| 61-104154 | 5/1986 | Japan . | |
| 62-3168 | 1/1987 | Japan . | |
| 63-167071 | 7/1988 | Japan . | |
| 63-246411 | 10/1988 | Japan . | |
| 63-248965 | 10/1988 | Japan . | |

*Primary Examiner*—Andres Kashnikow
*Assistant Examiner*—Christopher G. Trainor
*Attorney, Agent, or Firm*—Oliff & Berridge

[57] ABSTRACT

A fuel supply device comprising a pressurized air passage, a nozzle opening formed at a tip end of the pressurized air passage to inject fuel and pressurized air, a valve for opening or closing the nozzle opening, a fuel injector for injecting fuel in the pressurized air passage, and a guide member arranged in the pressurized air passage between the nozzle opening and the fuel injector. The guide member has a least three contacting faces which are in contact with a cylindrical inner wall of the pressurized air passage, and at least three substantially flat faces each extending approximately in a straight line between the contacting faces which are located on each side of the flat face to form a narrow passage between the cylindrical inner wall of the pressurized air passage and the flat face.

21 Claims, 9 Drawing Sheets

FUEL SUPPLY DEVICE OF AN ENGINE

This is a continuation of application Ser. No. 07/398,981 filed Aug. 28, 1989, now abandoned.

BACKGROUND OF THE INVENTION

1. Field of the Invention device of an engine.
2. Description of the Related Art In a known "air blast" valve, the opening and closing operation of the nozzle opening is electromagnetically controlled by a needle, to cause an injection of fuel by pressurized air. A pressurized air passage extending from the nozzle opening along the needle is formed around the needle and connected to a pressurized fuel source, a nozzle chamber open to the pressurized air passage is provided, and the nozzle of the fuel injector is arranged deep in the interior of the nozzle chamber. The needle has a guide portion formed thereon, this guide portion having three equally spaced lobes which are in slidable contact with the inner wall of the pressurized air passage, to support and guide the needle. Because of the provision of the lobes to support and guide the needle, passages formed between the lobes for the fuel-air charge must have a relatively large cross sectional area, to reduce flow resistance.

After fuel is injected from the fuel injector toward the needle, the needle opens the nozzle opening and the thus injected fuel is injected together with pressurized air from the nozzle opening of the air blast valve (see International Publication No. WO87/00583).

Where, however, passages formed between the lobes for the fuel-air charge have a relatively large cross sectional area, as in the above-mentioned air blast valve, when fuel is injected from the fuel injector toward the needle, most of the fuel injected from the fuel injector passes through passages formed between the lobes and collects in the pressurized air passage, near the nozzle opening, and as a result, the fuel collected near the nozzle opening is forced out as liquid fuel by the pressure of the pressurized air when the needle opens the nozzle opening, and thus a problem arises in that fuel injected from the nozzle opening is not fully atomized and is not completely mixed with the air.

SUMMARY OF THE INVENTION

An object of the present invention is to provide a fuel supply device capable of injecting fuel which has been fully atomized and completely mixed with the air, from the nozzle opening.

According to the present invention, there is provided a fuel supply device of an engine, comprising: a pressurized air passage; a nozzle opening formed at a tip end of the pressurized air passage for injecting fuel and pressurized air; a valve means for controlling the opening of the nozzle opening; a fuel supply means for supplying fuel to the pressurized air passage; and a guide member arranged in the pressurized air passage between the nozzle opening and the fuel supply means and having at least three contacting faces in contact with a cylindrical inner wall of the pressurized air passage. The guide member having at least three substantially flat faces each extending in an approximately straight line between the contacting faces which are located on each side of the flat face to form a fuel and air passage between the cylindrical inner wall of the pressurized air passage and the substantially flat face.

The present invention may be more fully understood from the description of preferred embodiments of the invention set forth below, together with the accompanying drawings.

DESCRIPTION OF PREFERRED EMBODIMENTS

Figure 4:
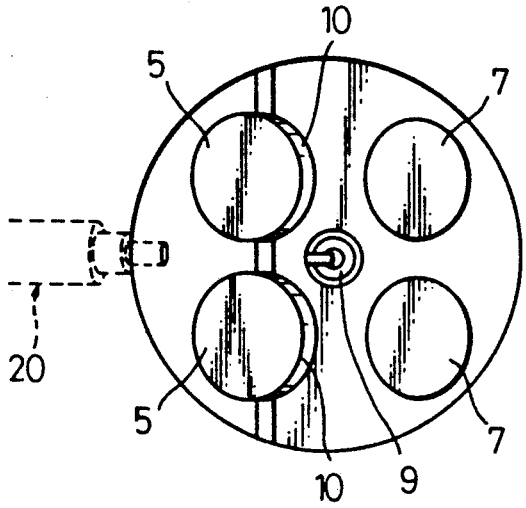
FIG. 4 is a bottom view of the inner wall of the cylinder head of a two-stroke engine.
Figure 5:
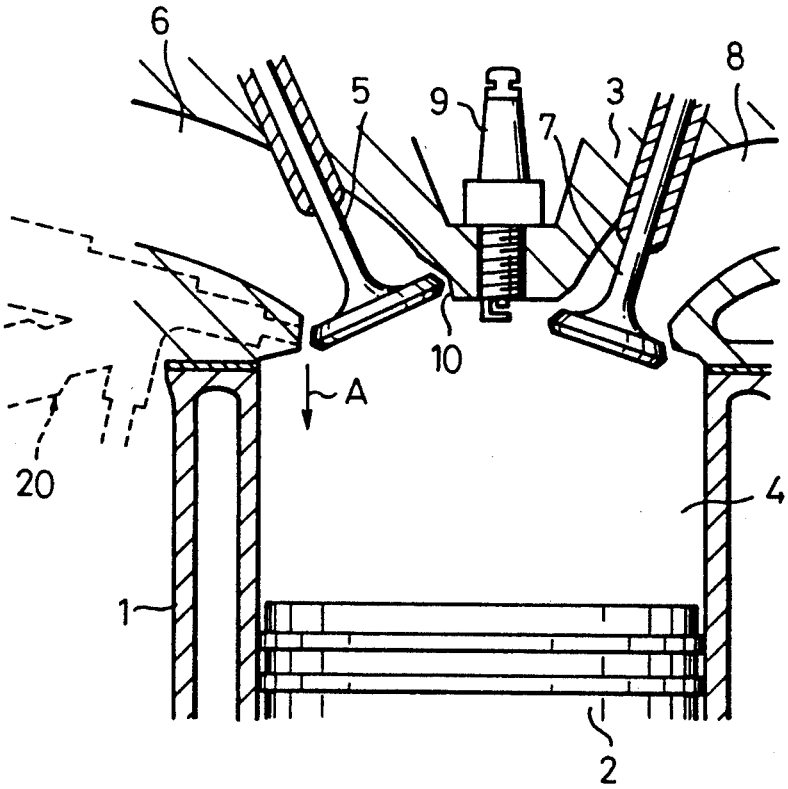
FIG. 5 is a cross-sectional side view of the two-stroke engine.

Referring to FIGS. 4 and 5, reference numeral 1 designates a cylinder block, 2 a piston, 3 a cylinder head, and 4 a combustion chamber; 5 designates a pair of intake valves, 6 intake ports, 7 a pair of exhaust valves, 8 exhaust ports; and 9 designates a spark plug. Masking walls 10, each masking the valve opening formed between the valve seat and the peripheral portion of the intake valve 5, which is located on the exhaust valve side, for the entire time for which the intake valve 5 is open, are formed on the inner wall of the cylinder head 3. Consequently, when the intake valves 5 open, fresh air flows into the combustion chamber 4 from the valve opening which is located at a position opposite to the exhaust valves 7, as illustrated by the arrow A in FIG. 5. An air blast valve 20 is arranged on the inner wall of the cylinder head 3 between the intake valves 5.

Figure 1:
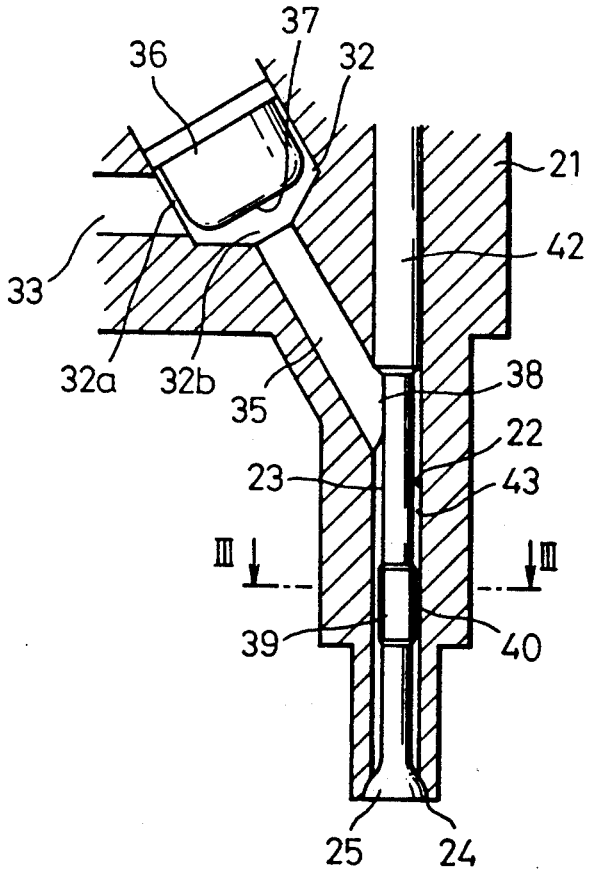
FIG. 1 is an enlarged cross-sectional side view of a portion of an air blast valve denoted by an arrow K in FIG. 2.
Figure 2:
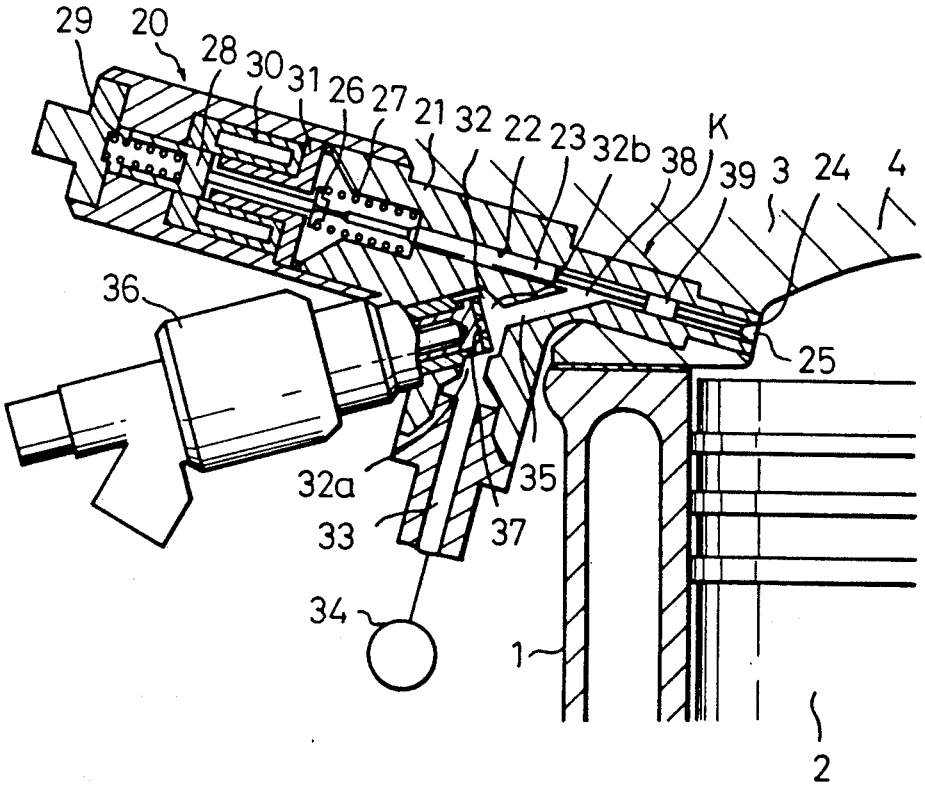
FIG. 2 is a partly cross-sectional side view of the air blast valve.

FIGS. 1 and 2 illustrate a first embodiment of the air blast valve 20. Referring to FIGS. 1 and 2, a straight needle insertion bore 22 is formed in the housing 21 of the air blast valve 20, and a needle 23 having a diameter smaller than that of the needle insertion bore 22 is inserted into the needle insertion bore 22. A nozzle opening 24 is formed at one end of the needle insertion bore 22, and the opening and closing operation of the nozzle opening 24 is carried out by the valve head 25 formed on the tip of the needle 23. In this embodiment, as shown in FIG. 2, the nozzle opening 24 is arranged in the combustion chamber 4, a spring retainer 26 is mounted on the needle 23, and a compression spring 27 is inserted between the spring retainer 26 and the housing 21. The nozzle opening 24 is normally closed by the valve head 25 of the needle 23 due to the spring force of the compression spring 27. A movable core 28 continuously abuts against the end portion of the needle 23, which is positioned opposite to the valve head 25, due to the spring force of the compression spring 29, and a solenoid 30 and a stator 31 are arranged in the housing 21 to attract the movable core 28. When the solenoid 30 is energized, the movable core 28 moves toward the stator 31, and at this time, since the needle 23 moves toward the nozzle opening 24 against the compression spring 27, the nozzle opening 24 is opened.

A nozzle chamber 32 having a cylindrical shape is formed in the housing 21. The nozzle chamber 32 has an air inlet 32*a* and an air outlet 32*b* separately formed from and spaced from the air inlet 32*a*. The air inlet 32*a* is connected to a pressurized air source 34 via a pressurized air inflow passage 33, and the air outlet 32*b* is connected to the needle insertion bore 22 via a pressurized air outflow passage 35. The nozzle 37 of a fuel injector 36 is arranged in the nozzle chamber 32 at a position between the air inlet 32*a* and the air outlet 32*b*.

As can be seen from FIGS. 1 and 2, the pressurized air outlet passage 35 extends in a straight line. The nozzle 37 of the fuel injector 36 is arranged on the axis of the pressurized air outlet passage 35, and fuel having a small spread angle is injected from the nozzle 37 along the axis of the pressurized air outflow passage 35. The pressurized air outlet passage 35 extends obliquely to the needle insertion bore 22 toward the nozzle opening 24 and is obliquely connected to the needle insertion bore 22 at a connecting portion 38, at an angle of 20 to 40 degrees with respect to the axis of the needle insertion bore 22.

Referring to FIG. 1, the needle 23 has an enlarged portion 42 formed thereon and slidably fitted into the nozzle insertion bore 22 at a position opposite to the nozzle opening 24 with respect to the connecting portion 38 of the pressurized air outlet passage 35 and the needle insertion bore 22, whereby a flow of pressurized air and fuel toward the solenoid 30 (FIG. 2) is prevented. Also, the needle 23 has a guide member 39 integrally formed thereon at a position midway between the nozzle opening 24 and the connecting portion 38 of the pressurized air outlet passage 35 and the needle insertion bore 22.

Figure 3:
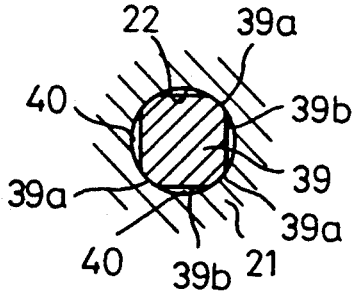
FIG. 3 is an enlarged cross-sectional view of the guide member, taken along the line III—III in FIG. 1.

FIG. 3 is an enlarged cross-sectional plan view of the guide member 39. Referring to FIG. 3, the guide member 39 has four cylindrical portions 39*a* in slidable contact with the cylindrical inner wall of the needle insertion bore 22, and four flat faces 39*b* each extending in a straight line between the cylindrical portions 39*a* which are located on each side of the flat face 39*b* to form a narrow passage 40 between the cylindrical inner wall of the needle insertion bore 22 and the flat face 39*b*. The cylindrical portion 39*a* has approximately the same radius as the cylindrical inner wall of the needle insertion bore 22. The cross section of the guide member 39 is shaped approximately as a square inscribed in the cylindrical inner wall of the needle insertion bore 22 at the cylindrical portion 39*a*. The sum of the cross-sectional areas of the four narrow passages 40 is considerably smaller than the cross-sectional area of the passage 43 (FIG. 1) formed between the needle 23 and the needle insertion bore 22. The cross-sectional area of the narrow passage 40 is constant along the axis of the needle 23.

Returning to FIGS. 1 and 2, the needle insertion bore 22, the nozzle chamber 32, and the pressurized air outflow passage 35 are connected to the pressurized air source 34 via the pressurized air inflow passage 33, and thus are filled with pressurized air. Fuel is injected into the pressurized air from the nozzle 37 along the axis of the pressurized air outflow passage 35. The injected fuel impinges on the needle 23 and the inner wall of the needle insertion bore 22, and at this time, a part of the fuel is instantaneously atomized and another part of the fuel forms an emulsion. As the cross-sectional area of the narrow passage 40 is relatively small, most of the injected fuel adheres to the inner and outer wall of the narrow passage 40 and collects in the needle insertion bore 22 upstream of the narrow passage 40, and only a very small amount of the fuel reaches the interior of the needle insertion bore 22 around the needle 23 near the valve head 25. Therefore, when the solenoid 30 is energized, the needle 23 opens the nozzle opening 24, and at this time, as soon as the needle 23 opens the nozzle opening 24, the very small amount of fuel in the needle insertion bore 22 near the valve head 25 is injected into the combustion chamber 4 (FIG. 2) from the nozzle opening 24. Further, when the needle 23 opens the nozzle opening 24, the pressurized air flows into the nozzle chamber 32 from the pressurized air inflow passage 33 via the air inlet 32*a*, and then flows toward the nozzle opening 24 via the pressurized air outflow passage 35 and the needle insertion bore 22. At this time, the injected fuel in the narrow passage 40 and the needle insertion bore 22 upstream of the narrow passage 40 is atomized by the pressurized air blowing within the needle insertion bore 22 and the narrow passage 40 and is carried away toward the nozzle opening 24 by the pressurized air, while being mixed with the pressurized air. Then, the fuel and the pressurized air are injected together from the nozzle opening 24 into the combustion chamber 4 (FIG. 2). Also the fuel stuck to the inner wall of the pressurized air outflow passage 35, the inner wall of the nozzle chamber 32, and the inner wall of the needle insertion bore 22 is carried away by the pressurized air and injected from the nozzle opening 24.

As mentioned above, when the needle 23 opens the nozzle opening 24, an extremely small amount of the fuel existing in the needle insertion bore 22 near the valve head 25 is initially injected from the nozzle opening 24, but immediately thereafter, fuel fully atomized and fully mixed with the air is injected from the nozzle opening 24. Consequently, the fuel fully atomized and fully mixed with the air is injected from the nozzle opening 24 from the beginning of the air-fuel injection, and thus it is possible to form a good air-fuel mixture in the combustion chamber 4 (FIG. 2).

In addition, as soon as the needle 23 opens the nozzle opening 24, the entire amount of injected fuel is injected from the nozzle opening 24 and, after the injection of the entire injected fuel is completed, only the pressurized air is injected from the nozzle opening 24. Then the solenoid 30 is deenergized, and thus the needle 23 closes the nozzle opening 24. Consequently, only the pressurized air is injected from the nozzle opening 24 immediately before the needle 23 closes the nozzle opening 24.

If fuel is still injected from the nozzle opening 24 immediately before the needle 23 closes the nozzle opening 24, when the flow area of the nozzle opening 24 becomes small due to the closing by the needle 23, and the velocity of the pressurized air flowing from the nozzle opening 24 becomes low, the fuel is not atomized, and thus the liquid fuel adheres to the wall around the nozzle opening 24; if the liquid fuel adheres to the wall around the nozzle opening 24, carbon accumulates on the wall around the nozzle opening 24 and affects the injecting operation. Nevertheless, in the embodiment illustrated in FIG. 2, since only the pressurized air is injected from the nozzle opening 24 immediately before the needle 23 closes the nozzle opening 24, the liquid fuel does not adhere to the wall around the nozzle opening 24, and therefore, carbon will not accumulate on the wall around the nozzle opening 24.

FIG. 5 illustrates the case where the air blast value 20 is used for a two-stroke engine, and the injection of fuel by the air blast valve 20 is started just before the intake valves 5 close. When the engine is operating under a light load, since the velocity of the fresh air A flowing into the combustion chamber 4 is low, the fuel injected from the air blast valve 20 is collected around the spark plug 9, and thus a good ignition can be obtained. When the engine is operating under a heavy load, since the velocity of the fresh air A flowing into the combustion chamber 4 is high, a strong loop scavenging operation is carried out. In addition, since the fuel injected from the air blast valve 20 is carried downward along the inner wall of the combustion chamber 4 by the fresh air A flowing in a loop shape, a homogenous air-fuel mixture is formed in the combustion chamber 4, and as a result, a high output power of the engine can be obtained.

Figure 6:
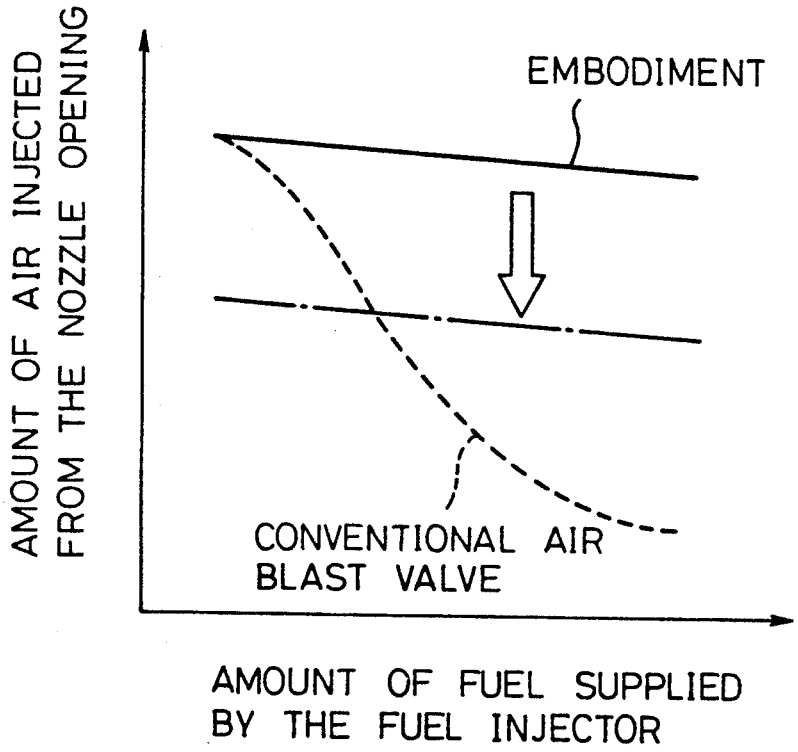
FIG. 6 illustrates the relationship between an amount of fuel supplied by the fuel injector and an amount of air injected from the nozzle opening.

FIG. 6 illustrates a relationship between an amount of fuel supplied by the fuel injector 36 and an amount of air injected from the nozzle opening 24. In the conventional air blast valve, as most of the fuel supplied by the fuel injector is collected in the needle insertion bore 22 near the valve head 25, the fuel is forced out of the nozzle opening 24 as liquid fuel by the pressure of the pressurized air. Therefore the fuel injected from the nozzle opening 24 is not fully atomized and completely mixed with the air. Since the pressurized air is not injected from the nozzle opening 24 before the fuel is forced out of the nozzle opening 24, the amount of air injected from the nozzle opening 24 is reduced in accordance with the increase of an amount of fuel supplied by the fuel injector 36. In this embodiment, an extremely small amount of fuel in the needle insertion bore 22 near the valve head 25 is initially injected from the nozzle opening 24, and then the fuel fully atomized and completely mixed with the air is injected from the nozzle opening 24. Accordingly, as shown in FIG. 6, since the amount of air injected from the nozzle opening 24 is not changed by the change of the amount of fuel supplied by the fuel injector 36, the maximum amount of air injected from the nozzle opening 24 can be reduced as shown by a phantom line in FIG. 6.

Figure 7:
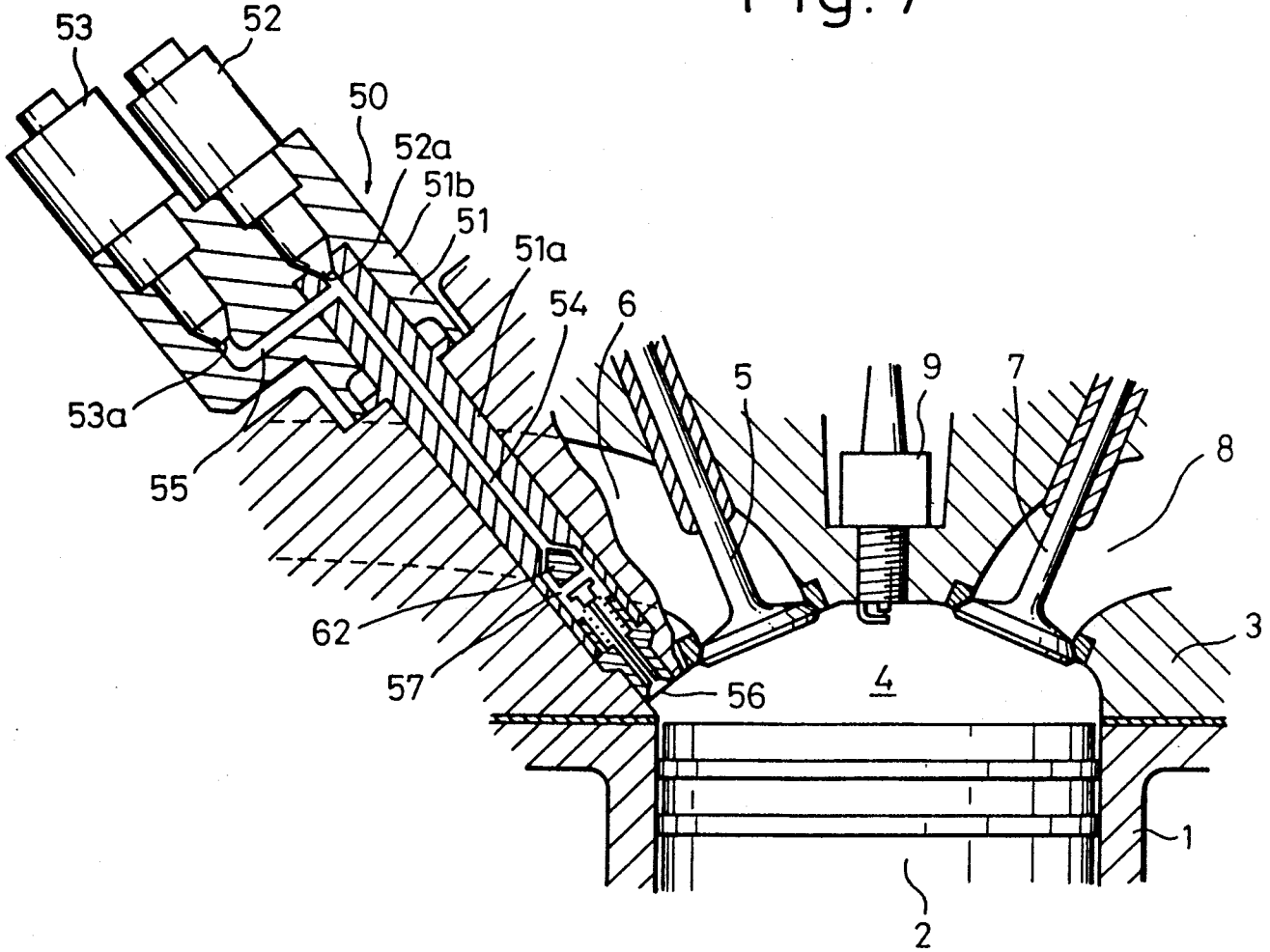
FIG. 7 is a partly cross-sectional side view of another embodiment of the air blast valve.

FIG. 7 illustrates a second embodiment of the present invention. Referring to FIG. 7, a housing 51 of an air blast valve 50 comprises a nozzle portion 51*a* and a body portion 51*b*. The nozzle portion 51*a* extends through the cylinder head 3, and the body portion 51*b* is fixed to the upper end of the nozzle portion 51*a*. A fuel injector 52 and an air injector 53 are arranged at the body portion 51*b*. A straight fuel and air supply bore 54 is formed in the nozzle portion 51*a*, and a nozzle opening 52*a* of the fuel injector 52 is arranged at the upper end of the fuel and air supply bore 54. Fuel having a small spread angle is injected from the nozzle opening 52*a* along the axis of the fuel and air supply bore 54. An air supply air bore 55 is connected to the upper end of the fuel and air supply bore 54 and a nozzle opening 53*a* of the air injector 53 is arranged at the end of the air supply bore 55. Pressurized air injected from the air injector 53 is supplied to the fuel and air supply bore 54 via the air supply bore 55. A nozzle opening 56 is formed at the lower end of the nozzle portion 51*a* and is arranged in the combustion chamber 4. An automatic opening and closing valve 57 for the opening and closing the nozzle opening 56 is arranged in the nozzle portion 51*a*.

Figure 8:
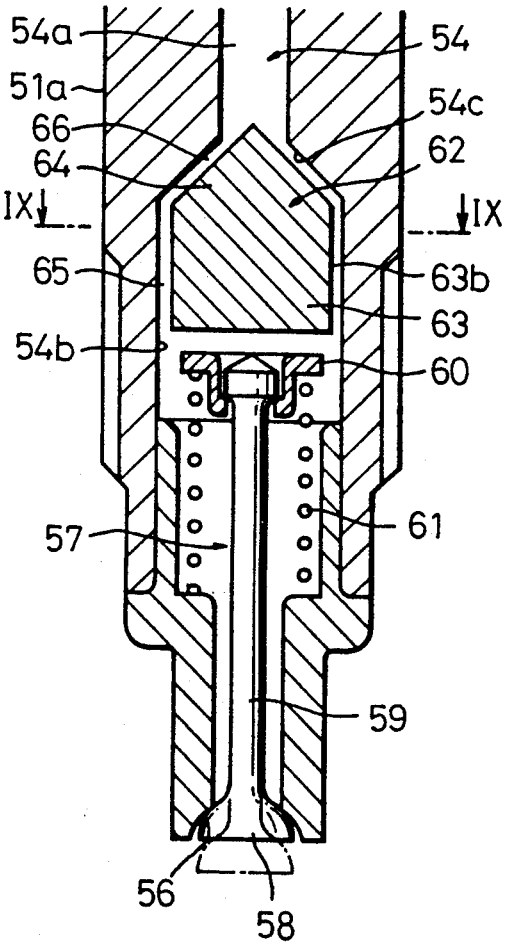
FIG. 8 is an enlarged cross-sectional side view of a tip portion of the air blast valve illustrated in FIG. 7.
Figure 9:
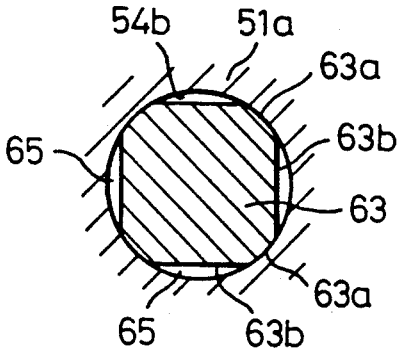
FIG. 9 is an enlarged cross-sectional view of the guide member, taken along the line IX—IX in FIG. 8.
Figure 10:
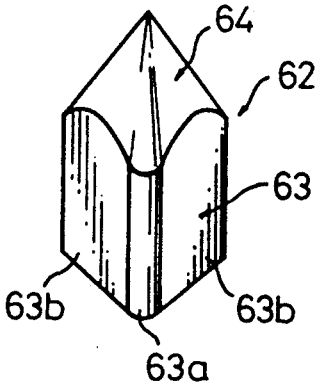
FIG. 10 is perspective view of the guide member.

Referring to FIGS. 8 through 10, the automatic opening and closing valve 57 comprises a mushroom-shaped valve head 58, a valve shaft 59 extending in and along the axis of the fuel and air supply bore 54, a spring retainer 60 arranged at the top of the valve shaft 59, and a compression spring 61 constantly urging the spring retainer 60 upward. As shown in FIG. 8, the nozzle opening 56 is normally closed by the valve head 58 due to the spring force of the compression spring 61. The fuel and air supply bore 54 comprises a small diameter portion 54*a* having a constant cross-sectional area and extending from near the spring retainer 60 to the fuel injector 52 (FIG. 7), and a large diameter portion 54*b* formed around the valve shaft 59 and extending upward. The small and the large diameter portions 54*a*, 54*b* are formed coaxially. The spring retainer 60 is arranged in the large diameter portion 54*b*. An upper end 54*c* of the large diameter portion 54*b* is formed into a conical shape by which the cross-sectional area thereof is gradually reduced upward, and the upper end 54*c* of the large diameter portion 54*b* is connected to the lower end of the small diameter portion 54*a*. A guide member 62 having a diameter larger than that of the spring retainer 60 is fitted into and fixed to the large diameter portion 54*b*. The guide member 62 has a base portion 63 and a head portion 64.

The head portion 64 is formed into a conical shape by which the cross-sectional area thereof is gradually reduced upward and is coaxial with the large diameter portion 54*b*. The base portion 63 has four cylindrical portions 63*a* in contact with the cylindrical inner wall of the large diameter portion 54*b*, and four flat faces 63*b* each extending between the cylindrical portions 63*a* which are located on each side of the flat face 63*b*. A narrow passage 65 having a constant cross-sectional area is formed between the flat face 63*b* and the large diameter portion 54*b*. Also, a narrow passage 66 having a constant cross-sectional area is formed between the head portion 64 and the upper end 54*c* of the large diameter portion 54*b*.

Figure 11:
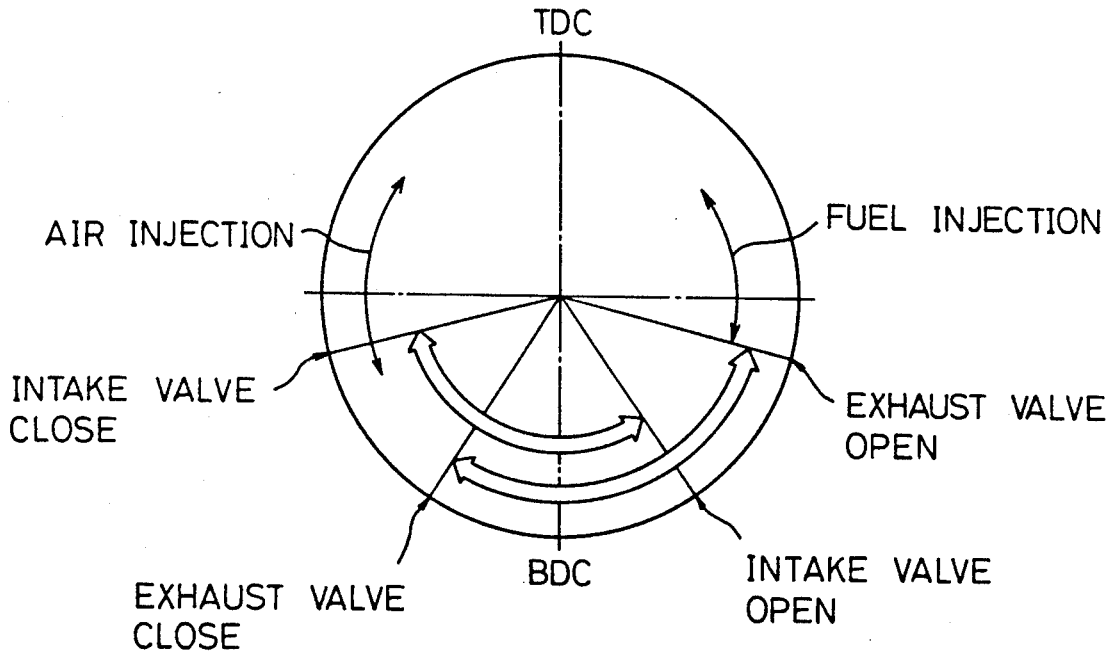
FIG. 11 is a diagram illustrating the opening timing of the intake valve and the exhaust valve.

FIG. 7 illustrates the case where the air blast valve 50 is used for a two-stroke engine, and FIG. 11 illustrates an example of the opening timing of the intake valves 5 and the exhaust valves 7, the fuel injection timing of the fuel injector 52, and the air injection timing of the air injector 53. As shown in FIG. 11, the air injection is started immediately before the closing of the intake valves 5, and the fuel injection from the fuel injector 52 is carried out at any time after the air injection is completed but before the next air injection is started.

Fuel is injected from the fuel injector 52 toward the guide member 62. As the cross-sectional area of the narrow passages 65, 66 is relatively small, a large part of fuel injected from the fuel injector 52 adheres to the inner walls and the outer walls of the narrow passages 65, 66, and thus a very small amount of the fuel reaches the valve head 58. Then, when pressurized air is injected from the air injector 53, the valve head 58 opens the nozzle opening 56 as illustrated by the phantom line in FIG. 8. At that time, as the cross-sectional area of the narrow passages 65, 66 is small, air flows in the narrow passages 65, 66 at a high speed, and thus the fuel stuck to the inner and outer walls of the narrow passages 65, 66 is atomized and carried away by the pressurized air. Accordingly, the injection of the atomized fuel from the nozzle opening 56 is started as soon as pressurized air is injected from the nozzle opening 56. In this embodiment, the first stage of the atomization of the fuel is carried out in the narrow passages 65, 66, and the second stage of the atomization of fuel is carried out when fuel is injected from the nozzle opening 56. Namely, in this embodiment, as two stages of the atomization of the fuel are carried out, fuel that is fully atomized and completely mixed with the air is injected from the nozzle opening 56 from the beginning of the air-fuel injecting operation.

Note, when air and fuel are injected from the nozzle opening 56, as the exhaust valves 7 are already closed, fuel injected from the nozzle opening 56 does not flow into the exhaust ports 8.

Figure 12:
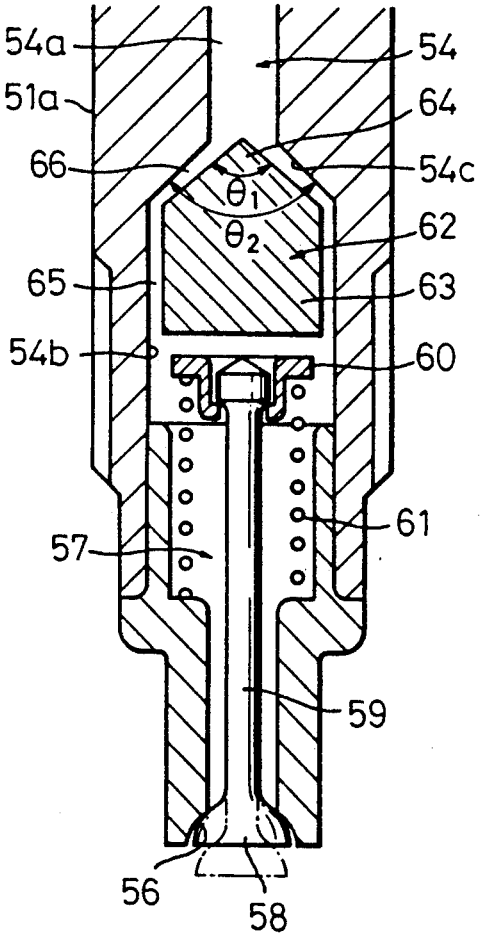
FIG. 12 is an enlarged cross-sectional side view of another embodiment of a tip portion of the air blast valve.
Figure 13:
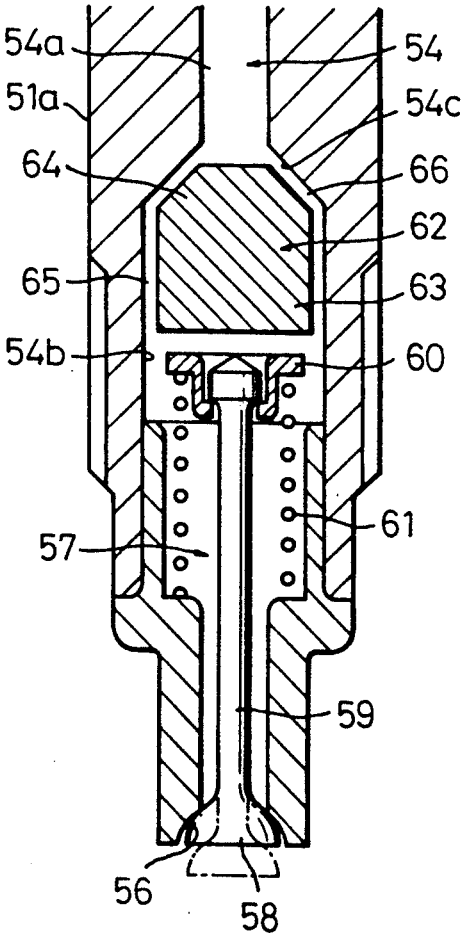
FIG. 13 is an enlarged cross-sectional side view of a further embodiment of a tip portion of the air blast valve.
Figure 14:
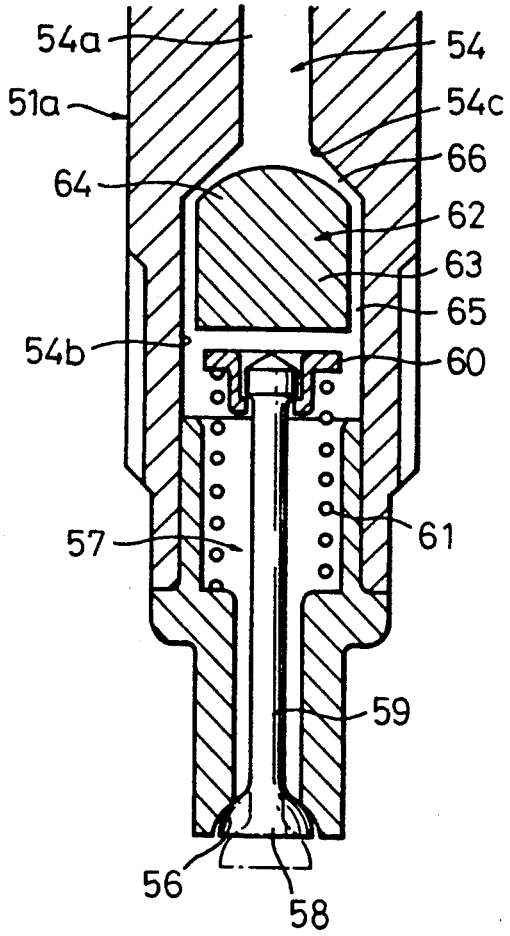
FIG. 14 is an enlarged cross-sectional side view of a still further embodiment of a tip portion of the air blast valve.

FIGS. 12 through 14 illustrate another embodiment wherein the shape of the head portion 64 of the guide member 62 is changed.

In the embodiment illustrated in FIG. 12, the apical angle $\theta_1$ of the head portion 64 formed in a conical shape is larger than the apical angle $\theta_2$ of the upper end 54*c* of the large diameter portion 54*b*, which is also formed in a conical shape. Accordingly, in the embodiment illustrated in FIG. 12, the cross-sectional area of the narrow passage 66 gradually becomes smaller in the downstream direction.

In the embodiment illustrated in FIG. 13, the head portion 64 is formed into the shape of a truncated cone.

In the embodiment illustrated in FIG. 14, the head portion 64 is formed into the shape of a sphere.

Note, the air blast valve according to this invention can be used for a four-stroke engine, and fuel may be injected to the intake port.

While the invention has been described with reference to specific embodiments chosen for purposes of illustration, it should be apparent that numerous modifications could be made thereto by those skilled in the art without departing from the basic concept and scope of the invention.

We claim:

1. A fuel supply device of an engine, comprising:

a fuel and air supply passage having ends and extending substantially linearly;

a nozzle opening formed at one end of said fuel and air supply passage for injecting fuel and pressurized air;

a fuel injector and an air injector arranged at the other end of said fuel and air supply passage;

an automatically opening and closing valve arranged at said nozzle opening and constantly urged toward a closing direction, said valve being opened by a pressure of pressurized air injected from said air injector and fuel injected from said fuel injector into said fuel and air supply passage, the fuel being injected from said nozzle opening by said pressurized air; and a guide member spaced apart from said a tomatically opening and closing valve and fixedly positioned in said fuel and air supply passage entirely between said automatically opening and closing valve and said fuel injector, a large part of fuel injected from said fuel injector being retained in a narrow passage formed between an outer surface of said guide member and an inner surface of said fuel and air supply passage when said automatically opening and closing valve closes said nozzle opening.

2. A fuel supply device according to claim 1, wherein said guide member has at least three contacting faces in contact with a cylindrical inner wall of said fuel and air supply passage, and said guide member having at least three substantially flat faces each extending approximately in a straight line between said contacting faces, said contacting faces located on each side of said flat face to form said narrow passage between said cylindrical inner wall of said fuel and air supply passage and said flat face.

3. A fuel supply device according to claim 2, wherein each said contacting face is formed by a part of a cylindrical face having approximately a same radius as that of said cylindrical inner wall.

4. A fuel supply device according to claim 2, wherein said guide member has four contacting faces and four substantially flat faces.

5. A fuel supply device according to claim 4, wherein a cross section of said guide member has a shape of approximately a square inscribed in said cylindrical inner wall at said contacting face.

6. A fuel supply device according to claim 1, wherein said fuel injector comprises a nozzle arranged on the axis of said fuel and air supply passage to inject fuel from said nozzle along the axis of said fuel and air supply passage.

7. A fuel supply device according to claim 1, wherein said automatically opening and closing valve comprises a valve head urged by a spring to close said nozzle opening.

8. A fuel supply device of an engine, comprising:

a fuel and air supply passage having ends and extending substantially linearly;

a nozzle opening formed at one end of said fuel and air supply passage for injecting fuel and pressurized air;

a fuel injector and an air injector arranged at the other end of said fuel and air supply passage;

an automatically opening and closing valve arranged at said nozzle opening and constantly urged toward a closing direction, said valve being opened by a pressure of pressurized air injected from said air injector and fuel injected from said fuel injector into said fuel and air supply passage, the fuel being injected from said nozzle opening by said pressured air; and a guide member arranged in said fuel and air supply passage between said automatically opening and closing valve and said fuel injector, a large part of fuel injected from said fuel injector being retained in a narrow passage formed between an outer surface of said guide member and an inner surface of said fuel and air supply passage when said automatically opening and closing valve closes said nozzle opening, wherein said fuel and air supply passage has an upstream passage and an enlarged passage downstream of said upstream passage, which has a cross-sectional area larger than that of said upstream passage, and said automatically opening and closing valve is arranged in said enlarged passage, said guide member being fitted into and fixed to said enlarged passage upstream of said automatically opening and closing valve.

9. A fuel supply device according to claim 8, wherein said enlarged passage and said upstream passage are in the form of a coaxial cylinder, and said enlarged passage and said upstream passage are connected by a conical passage, said guide member further comprising a head portion arranged in said conical passage to form said narrow passage between the inner face of said conical passage and the outer face of said head portion.

10. A fuel supply device according to claim 9, wherein said head portion is in the form of a cone which is coaxial with an axis of said conical passage, and said head portion is tapered toward said upstream passage.

11. A fuel supply device according to claim 10, wherein an apical angle of said head portion is larger than an apical angle of said conical passage.

12. A fuel supply device according to claim 9, wherein said head portion is in the form of a truncated cone which is coaxial with an axis of said conical passage, and said head portion is tapered toward said upstream passage.

13. A fuel supply device according to claim 9, wherein said head portion has a spherical shape.

14. A fuel supply device according to claim 8, wherein said automatically opening and closing valve comprises a valve shaft, a valve head formed at one end of said valve shaft to open and close said nozzle opening, and a spring retainer formed at the other end of said valve shaft to retain a spring which forces said valve head to close said nozzle opening, and said guide member faces said spring retainer and covers an entire face of said spring retainer, which faces said guide member.

15. A fuel supply device of an engine, comprising:

a fuel and air supply passage having ends and extending substantially linearly;

a nozzle opening formed at one end of said fuel and air supply passage for injecting fuel and pressurized air;

a fuel injector and an air injector arranged at the other end of said fuel and air supply passage;

an automatically opening and closing valve arranged at said nozzle opening and closing means for constantly urging said valve toward a closing direction, said valve being opened by a pressure of a pressurized air injected from said air injector and a fuel injected from said fuel injector into said fuel and air supply passage, the fuel being injected from said nozzle opening by said pressurized air; and a guide member spaced apart from said a tomatically opening and closing valve and fixedly positioned in said fuel and air supply passage between said automatically opening and closing valve and said fuel injector, and said closing means arranged between said guide member and said nozzle opening, a large part of fuel injected from said fuel injector being retained in a narrow passage formed between an outer surface of said guide member and an inner surface of said fuel and air supply passage when said automatically opening and closing valve closes said nozzle opening.

16. A fuel supply device according to claim 15, wherein said guide member has at least three contacting faces in contact with a cylindrical inner wall of said fuel and air supply passage, and said guide member having at least three substantially flat faces each extending approximately in a straight line between said contacting faces, said contacting faces located on each side of said flat face to form said narrow passage between said cylindrical inner wall of said fuel and air supply passage and said flat face.

17. A fuel supply device according to claim 16, wherein each said contacting face is formed by a part of a cylindrical face having approximately a same radius as that of said cylindrical inner wall.

18. A fuel supply device according to claim 16, wherein said guide member has four contacting faces and four substantially flat faces.

19. A fuel supply device according to claim 18, wherein a cross section of said guide member has a shape of approximately a square inscribed in said cylindrical inner wall at said contact face.

20. A fuel supply device according to claim 15, wherein said fuel injector comprises a nozzle arranged on the axis of said fuel and air supply passage to inject fuel from said nozzle along the axis of said fuel and air supply passage.

21. A fuel supply device according to claim 15, wherein said automatically opening and closing valve comprises a valve head urged by a spring to close said nozzle opening.

* * * * *